US011459964B2

(12) United States Patent
Hagner et al.

(10) Patent No.: US 11,459,964 B2
(45) Date of Patent: Oct. 4, 2022

(54) METHODS AND SYSTEMS FOR AN EXHAUST GAS RECIRCULATION SYSTEM

(71) Applicant: Ford Global Technologies, LLC, Dearborn, MI (US)

(72) Inventors: Dave Hagner, Beverly Hills, MI (US); Sumanth Dadam, New Hudson, MI (US); Sitaram Rejeti, Farmington, MI (US); Edward Doemer, Dearborn Heights, MI (US); Robert Jentz, Westland, MI (US); Patrick Edward Smithberger, Marine City, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/114,073

(22) Filed: Dec. 7, 2020

(65) Prior Publication Data

US 2022/0178319 A1 Jun. 9, 2022

(51) Int. Cl.

| | |
|---|---|
| ***F02D 41/00*** | (2006.01) |
| ***F02M 26/52*** | (2016.01) |
| ***F02M 26/22*** | (2016.01) |
| ***F02M 26/47*** | (2016.01) |

(52) U.S. Cl.

CPC ..... *F02D 41/0077* (2013.01); *F02D 41/0072* (2013.01); *F02M 26/22* (2016.02); *F02M 26/47* (2016.02); *F02M 26/52* (2016.02); *F02D 2200/0406* (2013.01)

(58) Field of Classification Search

CPC ..... F02D 41/0077; F02D 41/0072; F02D 2200/0406; F02M 26/52; F02M 26/47; F02M 26/22

See application file for complete search history.

(56) References Cited

U.S. PATENT DOCUMENTS

| | | | | |
|---|---|---|---|---|
| 5,520,161 | A * | 5/1996 | Klopp | F02D 41/0077 123/568.24 |
| 5,887,570 | A * | 3/1999 | Suzuki | F02P 5/1516 123/406.44 |
| 6,347,519 | B1 * | 2/2002 | Kreso | F02B 37/24 60/602 |
| 6,763,708 | B2 | 7/2004 | Ting et al. | |
| 6,804,601 | B2 * | 10/2004 | Wang | G05B 9/02 701/107 |
| 6,850,834 | B1 * | 2/2005 | Yu | G01F 1/76 73/114.74 |
| 7,715,976 | B1 * | 5/2010 | Xiao | F02M 26/46 73/114.74 |
| 8,201,442 | B2 * | 6/2012 | Osburn | G01F 1/88 73/114.74 |

(Continued)

FOREIGN PATENT DOCUMENTS

| | | | |
|---|---|---|---|
| CN | 2019-08007 | * | 9/2018 |
| JP | 2013144961 | A | 7/2013 |

*Primary Examiner* — Phutthiwat Wongwian
*Assistant Examiner* — Sherman D Manley
(74) *Attorney, Agent, or Firm* — Vincent Mastrogiacomo; McCoy Russell LLP

(57) ABSTRACT

Methods and systems are provided for a high-pressure exhaust gas recirculation system. In one example, the high-pressure exhaust gas recirculation system comprises pressure seconds arranged on different sides of a valve. The pressure sensors are used to regulate exhaust-gas recirculate flow without a fixed orifice delta pressure sensor.

18 Claims, 5 Drawing Sheets

(56) References Cited

U.S. PATENT DOCUMENTS

| | | | | |
|---|---|---|---|---|
| 8,469,010 | B2 * | 6/2013 | Inoue | F02D 41/18 123/698 |
| 8,776,501 | B2 * | 7/2014 | Carlill | F02D 9/04 60/297 |
| 9,976,521 | B1 * | 5/2018 | Jentz | F02D 41/26 |
| 10,619,582 | B2 * | 4/2020 | Lutz | F02D 41/0072 |
| 10,830,164 | B2 * | 11/2020 | Lahti | F02D 9/08 |
| 2007/0079614 | A1 * | 4/2007 | Barbe | F02M 26/47 60/605.1 |
| 2008/0022677 | A1 * | 1/2008 | Barbe | F02D 41/222 60/599 |
| 2008/0295514 | A1 * | 12/2008 | Ono | F02D 41/0235 60/602 |
| 2012/0117011 | A1 * | 5/2012 | Hashimoto | F02D 41/1405 706/23 |
| 2012/0130618 | A1 * | 5/2012 | Bleile | F02D 41/1448 73/114.74 |
| 2016/0186695 | A1 * | 6/2016 | Dudar | F02M 25/0809 73/40.5 R |
| 2017/0276067 | A1 * | 9/2017 | Hand, III | F02D 41/1444 |
| 2018/0058391 | A1 * | 3/2018 | Gibson | F02D 41/26 |
| 2018/0195446 | A1 * | 7/2018 | Mueller | F02D 41/1401 |
| 2019/0107040 | A1 * | 4/2019 | Tsumura | F02B 3/02 |
| 2019/0293010 | A1 * | 9/2019 | Madison | F01N 13/107 |
| 2019/0375395 | A1 * | 12/2019 | Jentz | F02M 26/49 |

* cited by examiner

METHODS AND SYSTEMS FOR AN EXHAUST GAS RECIRCULATION SYSTEM

FIELD

The present description relates generally to diagnosing sensors of an exhaust gas recirculation system.

BACKGROUND/SUMMARY

Engine systems may utilize recirculation of exhaust gas from an engine exhaust system to an engine intake system, a process referred to as exhaust gas recirculation (EGR), to reduce regulated emissions. An EGR valve may be controlled to achieve a desired intake air dilution for a given engine operating condition. Traditionally, the amount of low pressure EGR (LP-EGR) and/or high pressure EGR (HP-EGR) routed through the EGR system may be measured and adjusted based on engine speed, engine temperature, and load during engine operation to maintain desirable combustion stability of the engine while providing emissions and fuel economy benefits. EGR may cool combustion chamber temperatures which may reduce $NO_x$ formation.

In some existing implementations of EGR systems, EGR delivery may be measured via a fixed orifice and a pressure drop sensed across the orifice. The orifice pressure drop may be measured by a differential pressure sensor or two discrete pressure sensors, one of each side of the orifice. An orifice EGR flow measurement may be possible via characterizing a relationship between flow and the orifice pressure drop. The relationship may be stored in memory and retrieved during future EGR flow conditions to adjust EGR measured flow rate. The EGR measured flow rate can then be used by a controller to adjust an engine airflow, an in-cylinder fuel/air mixture burn rate, an engine output torque, and as a feedback signal in a closed loop EGR flow controller configuration, in which EGR flow is regulated by a valve separate from the fixed orifice.

In other examples, EGR systems may include measuring an EGR flow delivered by measuring or estimating a pressure drop across an EGR control valve. The EGR control valve measurement may characterize a relationship between flow and the orifice pressure drop. The value may be stored and used to adjust conditions similar to those described above. EGR flow measurements in either of these configurations may be dependent on the accuracy of the pressure sensors. Thus, pressure sensor diagnostics may be desired to detect degradation of one or more of the sensors. However, a magnitude of degradation of the pressure sensors may vary. In some examples, the pressure measurement may still be relatively accurate (e.g., outside a manufacturing tolerance but accurate relative to previous readings). Thus, errors committed by the sensors may be relatively small and complex and sophisticated methods may be needed to detect such an error.

In one example, the issues described above may be addressed by a system including a high-pressure exhaust gas recirculation (HP-EGR) system comprising a first sensor upstream of a valve and a second sensor downstream of the valve relative to a direction of exhaust gas flow, wherein the HP-EGR system is free of a fixed orifice delta pressure sensor. In this way, packaging of the EGR system may be less complex relative to previous HP-EGR systems.

As one example, the first sensor and the second sensor may demand periodic diagnostic testing to provide desired EGR flow rates. Outputs from the first sensor and the second sensor may be compared during certain engine operating conditions to one another, data stored in a look-up table, or to feedback from other sensors to determine if one or more of the sensors is degraded. By doing this, exhaust gas flow through the EGR system may be reliably regulated without the inclusion of the fixed orifice delta pressure sensor.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
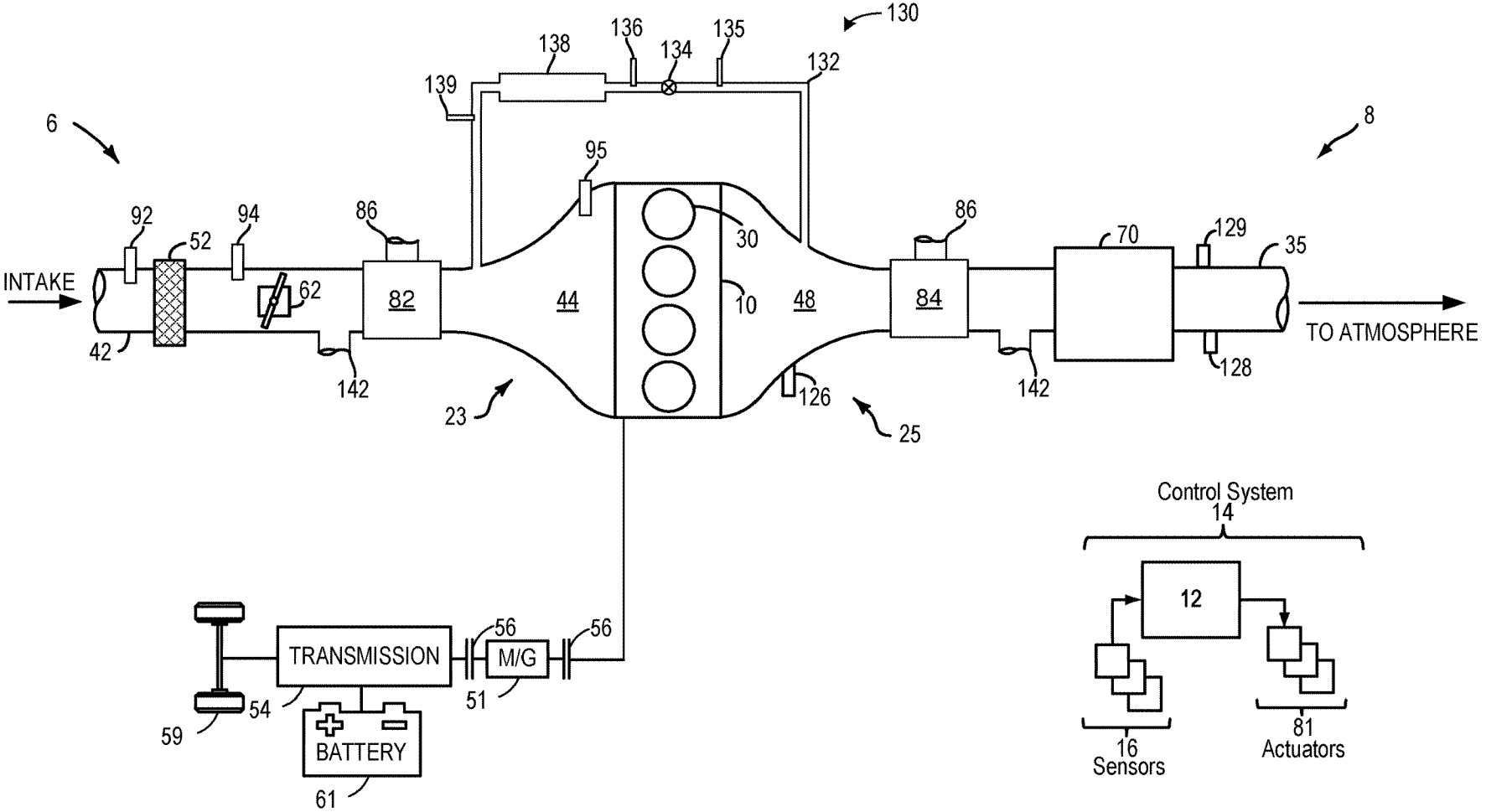
FIG. 1 illustrates a schematic of an engine included in a hybrid vehicle.

The following description relates to systems and methods for a high-pressure EGR system. The high-pressure EGR system may comprise a delta pressure over the valve (DPOV) configuration, wherein two independent pressure sensors are arranged upstream and downstream of an EGR valve. The high pressure EGR system is free of a fixed orifice delta pressure sensor and may rely on the two pressure sensors to regulate EGR flow through the EGR system in combination with the EGR valve. An example of the HP-EGR system arranged in an engine system of a hybrid vehicle is illustrated in FIG. 1. FIGS. 2-5 illustrate methods for diagnosing sensors and the EGR valve of the HP-EGR system during various engine conditions.

FIG. 1 shows a schematic depiction of a hybrid vehicle system 6 that can derive propulsion power from engine system 8 and/or an on-board energy storage device. An energy conversion device, such as a generator, may be operated to absorb energy from vehicle motion and/or engine operation, and then convert the absorbed energy to an energy form suitable for storage by the energy storage device.

Engine system 8 may include an engine 10 having a plurality of cylinders 30. Engine 10 includes an engine intake 23 and an engine exhaust 25. Engine intake 23 includes an air intake throttle 62 fluidly coupled to the engine intake manifold 44 via an intake passage 42. Air may enter intake passage 42 via air filter 52. The engine intake manifold 44 may further comprise a manifold absolute pressure (MAP) sensor 95. Engine exhaust 25 includes an exhaust manifold 48 leading to an exhaust passage 35 that routes exhaust gas to the atmosphere. Engine exhaust 25 may include at least one emission control device 70 mounted in a close-coupled position or in a far underbody position. The emission control device 70 may include a three-way catalyst, lean NOx trap, particulate filter, oxidation catalyst, etc. It will be appreciated that other components may be included in the engine such as a variety of valves and sensors, as further elaborated in herein. In some embodiments, wherein engine system 8 is a boosted engine system, the engine system may further include a boosting device, such as a turbocharger.

In the example of the present disclosure, the emission control device 70 is a particulate filter 70. In one example, the particulate filter 70 is a gasoline particulate filter. In another example, the particulate filter 70 is a diesel particulate filter.

The engine system 8 further comprises a turbocharger having a compressor 82 and a turbine 84. The compressor 82 and the turbine 84 are mechanically coupled via a shaft 86. The turbine 84 may be driven via exhaust gases flowing through the exhaust passage 35. The exhaust gases may rotate a rotor of the turbine 84, which may rotate the shaft 86, resulting in rotation of a rotor of the compressor 82. The compressor 84 is configured to receive and compress intake air.

The engine system 8 further comprises an exhaust-gas recirculation (EGR) system 130. In the example of FIG. 1, the EGR system 130 is a high-pressure EGR system where exhaust gases are drawn from a location of the engine exhaust 25 upstream of the turbine 84. The EGR system 130 comprises an EGR valve 134 arranged upstream of a heat exchanger 138, relative to a direction of exhaust gas flow in an EGR passage 132.

The EGR system 130 further comprises a first pressure sensor 135, a second pressure sensor 136, and a temperature sensor 139. Herein, the first pressure sensor 135 is referred to as an exhaust pressure sensor 135 and the second pressure sensor 136 is referred to as an EGR pressure sensor 136. The exhaust pressure sensor 135 may be arranged upstream of the EGR valve 134 and the EGR pressure sensor 136 may be arranged downstream of the EGR valve, relative to a direction of exhaust gas flow, between the EGR valve 134 and the heat exchanger 138. The temperature sensor 139 may be arranged downstream of the heat exchanger 138. Each of the exhaust pressure sensor 135, the EGR pressure sensor 136, and the temperature sensor 139 may be configured to provide feedback to the controller 12. As illustrated, the EGR system 130 is a high-pressure EGR system free of a fixed orifice delta pressure sensor. As such, the exhaust pressure sensor 135 and the EGR pressure sensor 136 are independent pressure sensors configured to monitor pressures upstream and downstream of a variable orifice (e.g., the EGR valve 134) in a delta pressure over the valve (DPOV) system.

In one example, the heat exchanger 138 may be a liquid-to-liquid or an air-to-liquid cooler. The heat exchanger 138 may be configured to receive coolant from a cooling system of the hybrid vehicle 6, such as an engine cooling system or other similar cooling system. Additionally or alternatively, the heat exchanger 138 may comprise a cooling system separate from other cooling system of the hybrid vehicle 6. In some examples, a bypass passage may be included in the EGR system 130, wherein the bypass passage is configured to flow pressurized exhaust gases around the heat exchanger 138 during conditions where cooling may not be desired. In one example, cooling may not be desired during conditions where an engine temperature is less than a desired temperature, such as during a cold-start.

In the example of FIG. 1, the hybrid vehicle 6 further comprises a low-pressure (LP) EGR passage 142. The LP-EGR passage 142 is configured to divert exhaust gases from downstream of the turbine 84 to a portion of the intake passage 42 upstream of the compressor 82. Additionally or alternatively, in some examples, the hybrid vehicle 6 may be configured without the LP-EGR passage 142 without departing from the scope of the present disclosure.

Hybrid vehicle 6 may further include control system 14. Control system 14 is shown receiving information from a plurality of sensors 16 (various examples of which are described herein) and sending control signals to a plurality of actuators 81 (various examples of which are described herein). As one example, sensors 16 may include exhaust gas pressure sensor 126 located upstream of the emission control device, temperature sensor 128, and pressure sensor 129. Other sensors such as additional pressure, temperature, air/fuel ratio, and composition sensors may be coupled to various locations in the vehicle system 6. As another example, the actuators may include the throttle 62.

Controller 12 may be configured as a conventional microcomputer including a microprocessor unit, input/output ports, read-only memory, random access memory, keep alive memory, a controller area network (CAN) bus, etc. Controller 12 may be configured as a powertrain control module (PCM). The controller may be shifted between sleep and wake-up modes for additional energy efficiency. The controller may receive input data from the various sensors, process the input data, and trigger the actuators in response to the processed input data based on instruction or code programmed therein corresponding to one or more routines.

In some examples, hybrid vehicle 6 comprises multiple sources of torque available to one or more vehicle wheels 59. In other examples, vehicle 6 is a conventional vehicle with only an engine, or an electric vehicle with only electric machine(s). In the example shown, vehicle 6 includes engine 10 and the electric machine 51. Electric machine 51 may be a motor or a motor/generator. A crankshaft of engine 10 and electric machine 51 may be connected via a transmission 54 to vehicle wheels 59 when one or more clutches 56 are engaged. In the depicted example, a first clutch 56 is provided between a crankshaft and the electric machine 51, and a second clutch 56 is provided between electric machine 51 and transmission 54. Controller 12 may send a signal to an actuator of each clutch 56 to engage or disengage the clutch, so as to connect or disconnect crankshaft from electric machine 51 and the components connected thereto, and/or connect or disconnect electric machine 51 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 51 receives electrical power from a traction battery 61 to provide torque to vehicle wheels 59. Electric machine 51 may also be operated as a generator to provide electrical power to charge battery 61, for example during a braking operation.

As will be described herein, pressure sensors of the EGR system 130 may be periodically diagnosed for operation outside of a desired tolerance. The desired tolerance may be relatively small such that errors detected during the diagnostic may also be relatively small. As such, determining these errors may be relatively challenging without additional sensors or advanced hardware. Herein, methods are described for detecting errors in the sensors in a low-cost system without additional sensors and hardware relative to those shown in the example of FIG. 1.

FIG. 1 shows an example configuration with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

Figure 2:
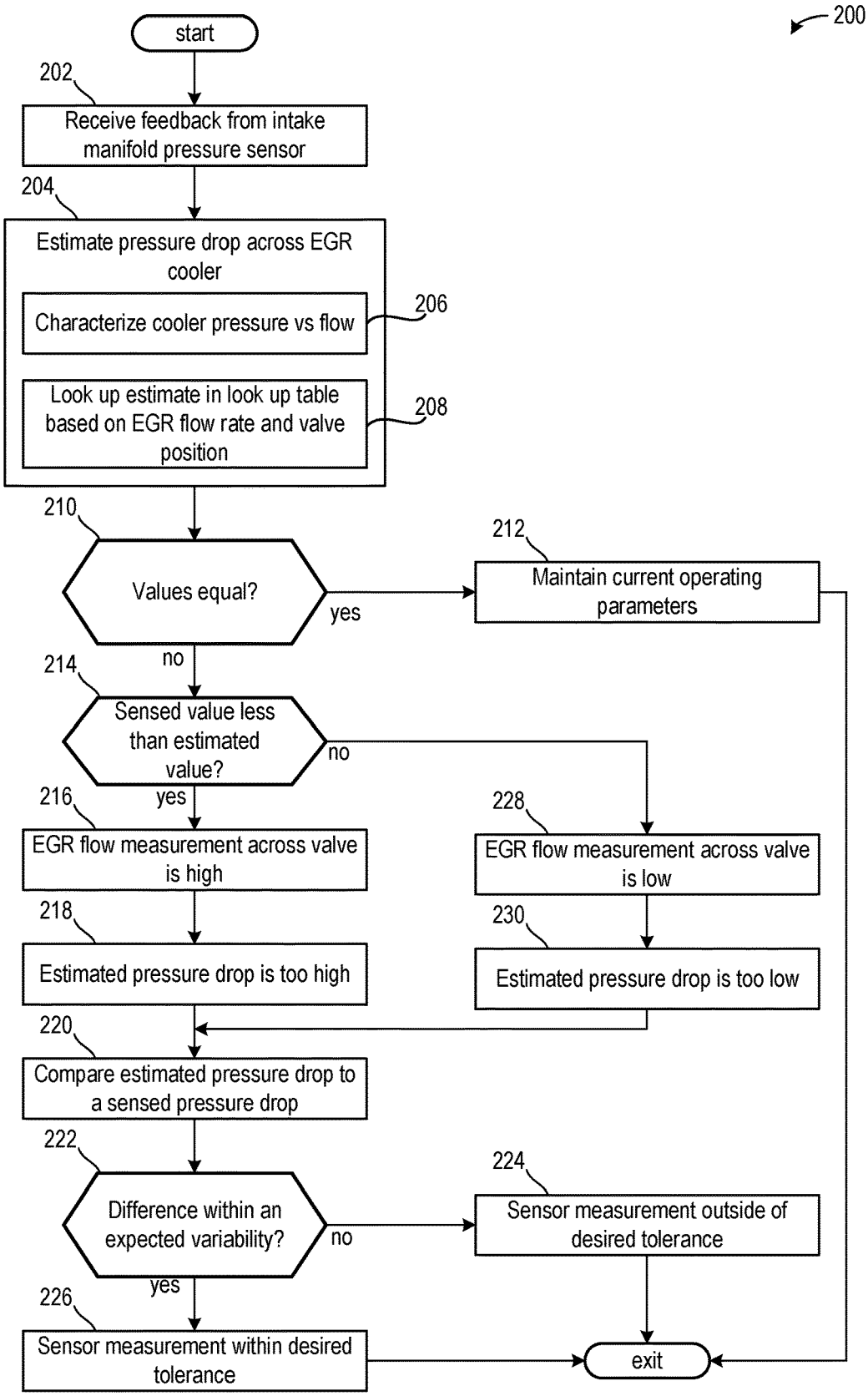
FIG. 2 illustrates a method for comparing a sensed cooler pressure drop to an estimated pressure drop.

Turning now to FIG. 2, it shows a method 200 for comparing a sensed pressure to an estimated pressure to determine if an EGR system sensor is operating within a desired tolerance. Instructions for carrying out method 200 and the rest of the methods included herein may be executed by a controller based on instructions stored on a memory of the controller and in conjunction with signals received from sensors of the engine system, such as the sensors described above with reference to FIG. 1. The controller may employ engine actuators of the engine system to adjust engine operation, according to the methods described below.

The method 200 begins at 202, which includes receiving feedback from manifold absolute pressure (MAP) sensor. The MAP sensor may be identical to the MAP sensor 95 of FIG. 1. Additionally or alternatively, the intake manifold pressure may be estimated via one or more engine operating conditions including an engine speed, a throttle position, a mass air flow, and a vehicle speed.

The method 200 may proceed to 204, which includes estimating a pressure drop across an EGR cooler. Estimating the pressure drop may include characterizing a cooler pressure against an EGR flow at 206 and using inputs of the characterization to look up an estimated pressure drop in a look-up table at 208.

For example, the EGR cooler pressure drop is estimated by characterizing a cooler pressure against a flow relationship. For example, a pressure upstream of the cooler may be greater than downstream of the cooler due to matter build up in the cooler. However, if matter accumulation is below a threshold load, then a pressure drop across the cooler may be relatively low. As such, pressure drops may be characterized for a plurality of EGR flows and stored in the look-up table. During vehicle operation, the characterization is looked up using an estimated EGR flow. The estimated EGR flow may be based on feedback from an exhaust gas pressure sensor, an EGR pressure sensor, and a valve position actuator.

The method 200 proceeds to 210, which includes comparing feedback from the MAP sensor to the EGR pressure sensor to determine if a difference between the MAP sensor and EGR pressure sensor are within a desired range of the estimated pressure drop. In one example, the desired range is based on an in-range error set at a factory. In one example, the desired tolerance is ±5% of the estimated pressure drop. Additionally or alternatively, the desired tolerance is ±2% of the estimated pressure drop. Additionally or alternatively, the desired tolerance is ±1% of the estimated pressure drop.

Operation of the EGR pressure sensor may be checked via equation 1 below.

$$P_{_valve_ds}=P_{_intake}+P_{_delta_cooler} \quad \text{(Equation 1)}$$

$P_{_intake}$ may be equal to feedback from the intake manifold pressure sensor. $P_{_delta_cooler}$ is equal to the estimated cooler pressure drop. In this way, feedback from the EGR pressure sensor is compared to $P_{_valve_ds}$. As such, in one example, there may be a first $P_{_valve_ds}$ value and a second $P_{_valve_ds}$ value, wherein the first $P_{_valve_ds}$ is directly equal to the feedback from the EGR pressure sensor and the second $P_{_valve_ds}$ is equal to an expected feedback based on the estimated pressure drop and MAP sensor feedback.

If the two values are equal or within the desired tolerance, then the method 200 proceeds to 212, which includes maintaining current operating parameters. The EGR pressure sensor is operating as desired and is not indicated as degraded.

If the two values are not equal, then the method 200 proceeds to 214, which includes determining if the sensed value is less than the estimated value based on equation 1. If the sensed value is less than the estimated value, then the method 200 proceeds to 216, which includes an EGR flow measurement across the EGR valve being too high. That is to say, the EGR pressure sensor is incorrectly sensing a low pressure, which then causes the EGR flow measurement across the EGR valve to be too high. This is due to a lower sensed downstream pressure resulting in a larger valve pressure drop calculation. This may result in insufficient EGR being delivered to the intake manifold.

The method 200 may proceed to 218, which includes determining the estimated pressure drop across the EGR cooler is too high. This is due to the high EGR flow measurement leading to the high estimated EGR cooler pressure drop. Thus, the cooler pressure drop is proportional to a cooler gas volumetric flow rate, which is proportional to a cooler gas mass flow rate. Thus, the EGR pressure sensor is sensing a value lower than an actual value, resulting in the estimated pressure being higher.

The method 200 proceeds to 220, which includes comparing the EGR pressure sensor sensed pressure with the estimated pressure.

The method 200 proceeds to 222, which includes determining if a difference between the sensed pressure and the estimated pressure is within the desired tolerance. If the difference between the sensed pressure and the estimated pressure is not within the desired tolerance, then the method 200 proceeds to 224, which includes determining that the sensor measure is outside of the desired tolerance. Furthermore, in some examples, the sensor may be indicated as being degraded.

In some examples of the method 200, a correction factor may be determined based on the difference such that future values sensed by the EGR pressure sensor are adjusted via the correction factor. By doing this, EGR flow conditions may be enhanced without replacing the EGR pressure sensor.

Returning to 222, if the difference is within the desired tolerance, then the method 200 proceeds to 226, which includes determining that the sensor measurement is within desired tolerance. As such, feedback from the EGR pressure sensor may be used without adjustment.

Returning to 214, if the sensed value is not less than the estimated value, then the method 200 proceeds to 228, which includes determining the EGR flow measurement across the valve is lower than an actual value. The EGR pressure sensor senses an inaccurate high EGR pressure, which results in an EGR flow measurement across the valve being low due to the higher valve downstream pressure leading to a lower valve pressure drop calculation.

The method 200 proceeds to 230, which includes determining the estimated cooler pressure drop is too low. The low EGR flow measurement leads to the low estimated cooler pressure drop. Thus, in the present example, the EGR pressure sensor is sensing a higher pressure than the estimated pressure. These values are compared at 222 as described above.

In some examples of the method 200, an EGR cooler cleaning request may be determined following 210. In one example, the EGR pressure sensor may be determined to be not degraded during another diagnostic test, such as during as no flow condition as described below with respect to FIG. 3. If the EGR pressure sensor is not degraded, but the calculated EGR pressure sensor feedback and the actual EGR pressure sensor feedback are not within a desired range, then the EGR cooler may comprise an amount of matter greater than a threshold load, resulting in a large pressure drop due to exhaust gas flow being impeded therethrough due to a restriction.

Figure 3:
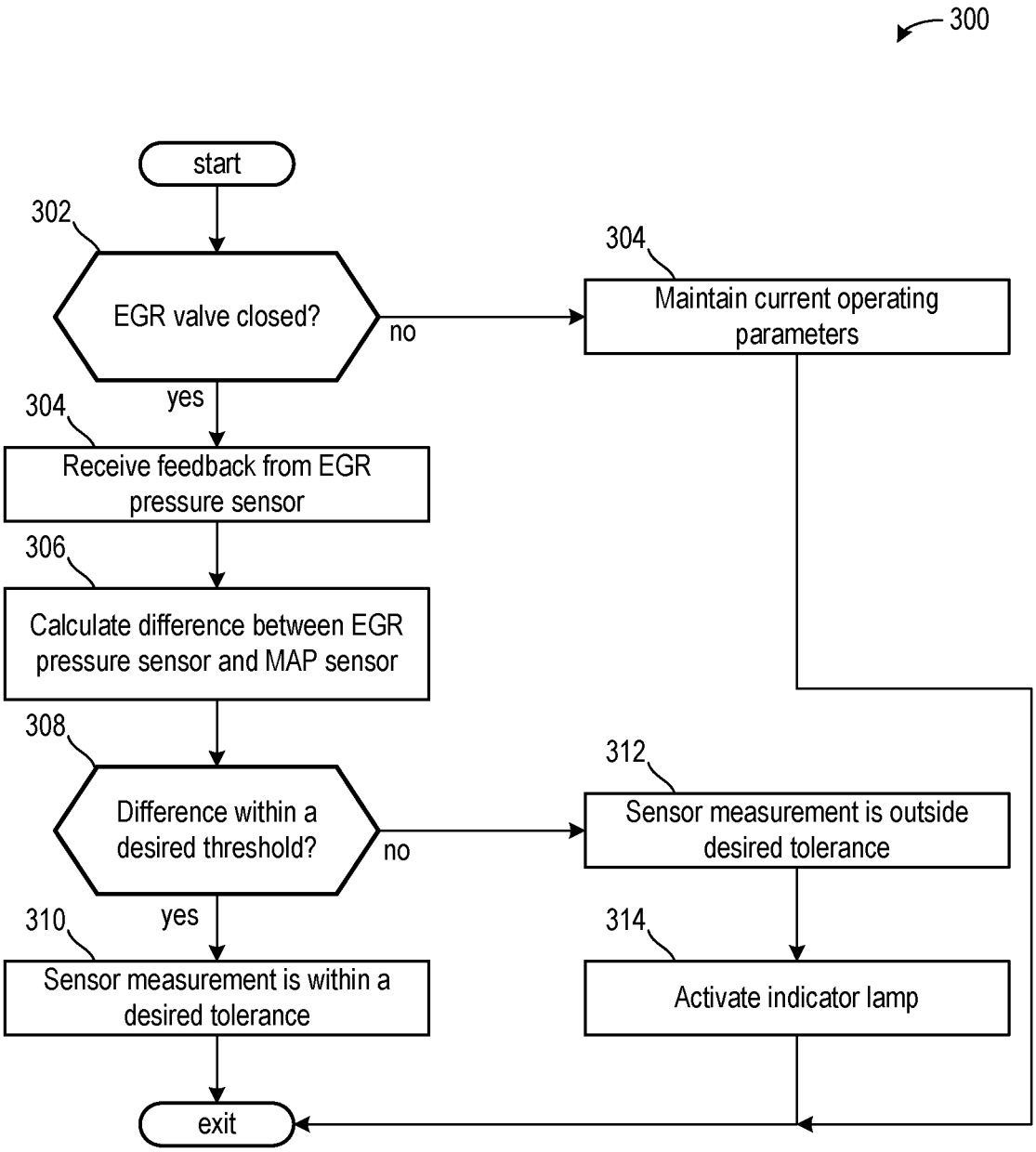
FIG. 3 illustrates a method for detecting an EGR pressure sensor degradation during a no-flow EGR condition.

Turning now to FIG. 3, it shows a method 300 for diagnosing a sensor degradation during an EGR valve closed operating condition (e.g., a no flow condition).

The method 300 begins at 302, which includes determining if an EGR valve is closed. If the EGR valve is not closed, then the method 300 proceeds to 304, which includes maintaining current operating parameters and does not monitor the EGR system at a no flow condition due to EGR flowing. The method 300 may optionally proceed to 202 of FIG. 2 if EGR monitoring during EGR flow conditions is desired.

If the EGR valve is closed, then the method 300 proceeds to 304, which includes receiving feedback from the EGR pressure sensor.

The method 300 proceeds to 306, which includes calculating a difference between the EGR pressure sensor and the MAP sensor.

The method 300 proceeds to 308, which includes determining if the difference is within a desired threshold. In one example, the desired threshold is based on a percentage of the feedback from the intake manifold pressure sensor. For example, the desired threshold may be range of ±five or two or one percent of the feedback from the intake manifold pressure sensor.

If the difference is within the desired threshold, then the method 300 proceeds to 310, which includes indicating that the EGR pressure sensor measurement is within the desired tolerance. As such, the EGR pressure sensor is not degraded.

If the difference is not within the desired threshold, then the method 300 proceeds to 312, which includes determining the EGR pressure sensor measurement is outside the desired tolerance. The method 300 proceeds to 314 to activate an indicator lamp indicating replacement of or service to the EGR pressure sensor is desired. In some examples, additionally or alternatively, a multiplier may be calculated based on the difference, wherein the multiplier may be a correction factor configured to adjust output from the EGR pressure sensor to fall within the desired threshold.

Figure 4:
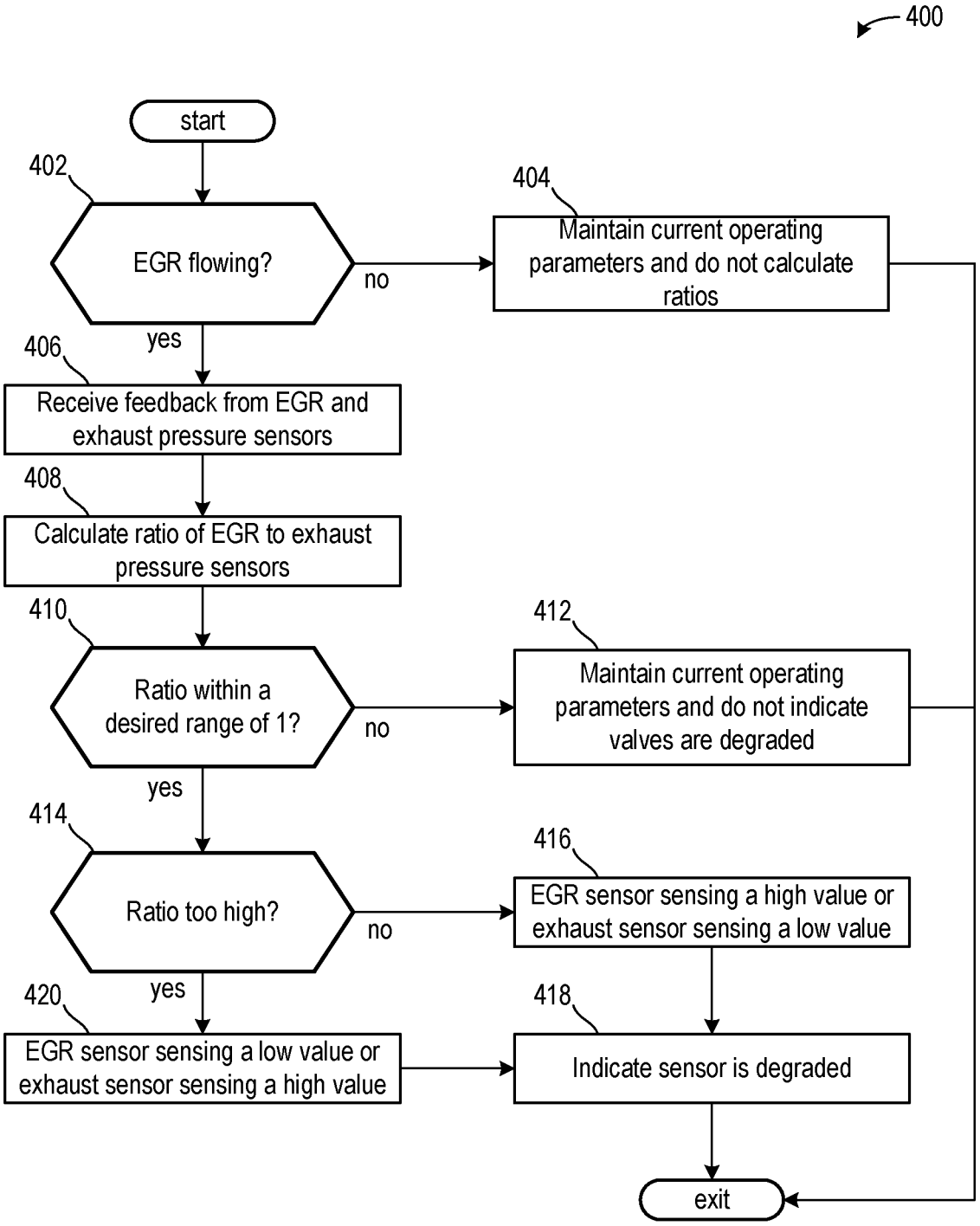
FIG. 4 illustrates a method for determining a ratio between an exhaust gas pressure sensor and an EGR pressure sensor for a plurality of EGR valve positions.

Turning now to FIG. 4, it shows a method 400 for evaluating an EGR pressure sensor against an exhaust pressure to determine a ratio thereof at a variety of valve positions.

The method 400 begins at 402, which includes determining if EGR is flowing. EGR may be flowing if an EGR valve is outside of a fully closed position. In some examples, the method may further include determining if an opening of the EGR valve is greater than a threshold opening, wherein feedback from the EGR pressure sensor and the exhaust pressure sensor are substantially equal for exhaust flows when the EGR valve is open beyond the threshold opening. If EGR is not flowing and the EGR valve is fully closed, then the method 400 proceeds to 404, which includes maintaining current operating parameters and does not calculate pressure ratios of the EGR pressure sensor and the exhaust gas pressure sensor. In some examples, the method 300 may be executed following 402, if desired.

If EGR is flowing and the EGR valve is outside of the fully closed position, then the method 400 proceeds to 406, which includes receiving feedback form the EGR and exhaust pressure sensors.

The method 400 proceeds to 408, which includes calculating a ratio between the EGR and exhaust pressure sensors. That is to say, a pressure ratio based on the feedback from the sensors is calculated.

The method 400 proceeds to 410, which includes determining if the ratio is within a desired range of a reference value of 1. In some examples, the desired range may be a fixed value independent of an EGR valve position. In some examples, the reference value 1 may be adjusted based on positions of the EGR valve. For example, following the threshold opening (e.g., 30% or more opening of the EGR valve, the reference value may be one. However, for EGR valve positions between 1 to 30%, the reference value may be greater than 1 due to the exhaust pressure sensor sensing higher pressures than the EGR pressure sensor at less open EGR valve positions.

At any rate, if the ratio is within the desired range of 1, then the method 400 proceeds to 412, which includes maintaining current operating parameters and does not indicate the valves are degraded. As such, a correction factor may not be calculated. Furthermore, an alert is not displayed and/or sent requesting service to the valve(s).

If the ratio is not within the desired range of 1, then the method 400 proceeds to 414, which includes determining if the ratio is too high. If the ratio is not too high, then the method 400 proceeds to 416, which includes the EGR pressure sensor sensing a high value or the exhaust pressure sensor sensing a low value.

The method 400 proceeds to 418 to indicate one of the EGR pressure sensor or the exhaust pressure sensor is degraded. In one example, if the EGR pressure sensor is determined to be degraded in the method 300 of FIG. 3, then the method 400 may be used as a confirmation of the EGR pressure sensor being degraded. As such, the method 400 may indicate the EGR pressure sensor is degraded at 418. Alternatively, if the EGR pressure sensor is determined to not be degraded in method 300 of FIG. 3, then the method 400 may indicate the exhaust pressure sensor is degraded at 418.

Returning to 414, if the ratio is too high, then the EGR pressure sensor is sensing a low value or the exhaust pressure sensor is sensing a high value at 420. The method 400 proceeds to 418 to indicate a sensor is degraded. As described above, the method 400 may be used in combination with the method 300 to determine which of the exhaust pressure sensor or the EGR pressure sensor is degraded.

In some examples of the method 400, a correction factor may be calculated following 418. The correction factor may be based on a difference between the ratio and an outer limit of the desired range relative to 1. For example, as the difference increases, then the correction factor may also increase. The correction factor may be further calculated for the various EGR valve positions at which the ratio is outside of the desired range of 1. As such, a plurality of correction factors may be stored in a look-up table, wherein an input of the look-up table includes the EGR valve position. In this way, a less open EGR valve may comprise a first correction factor and a more open EGR valve may comprise a second correction factor different than the first. The correction factor may be applied to feedback from one of the exhaust pressure sensor or the EGR pressure sensor.

In some examples of the method 400, multiple diagnostics may be run at various EGR valve positions. If the ratio is not within 1 by the desired range for a plurality of EGR valve positions, then one of the exhaust pressure or EGR pressure sensor may be indicated as degraded. However, if the ratio is within 1 for some positions and not within 1 for other positions by an amount equal to the desired range, then operating parameters may be adjusted for the positions at which the sensor is inaccurately sensing a pressure. For example, corrections factors may only be applied at the EGR valve positions where the deviation from the ratio of 1 is determined to be greater than the desired range. In this way, EGR flow rates may be accurately achieved without replacing either of the sensors.

In some examples, one or more of the methods 200, 300, and 400 may be utilized for determining a particular sensor degradation and/or for determining if diagnostic entry conditions are met. As a real-world example, the cooler may become restricted due to carbon build up from gases flowing therethrough. As such, prior to diagnosing the exhaust gas and EGR pressure sensors of the EGR system, the cooler pressure drop may be measured and/or estimated. In one example, the cooler integrity may be determined based on a comparison of the EGR pressure sensor and the MAP sensor (e.g., at a no flow condition similar to that described in method 300). Additionally or alternatively, the estimated pressure drop across the cooler in method 200 may be used in combination with the comparison of the EGR pressure sensor and the MAP sensor. For example, if method 200 determines an irregularity and the comparison of method 300 determines that the EGR pressure sensor is substantially equal to the MAP sensor during no flow conditions, then it may be determined that the cooler demands a cleaning due to particulate matter build up being greater than a threshold build-up.

As another example, such as in the example method 400 of FIG. 4, a ratio of the EGR pressure sensor and the exhaust pressure are substantially equal following openings greater than a threshold opening of the EGR valve. During such a condition, if the ratio of the EGR pressure sensor and the exhaust pressure sensor are not within a desired range of 1, then the one or more of the EGR valve may comprise a restriction, an EGR conduit (e.g., an EGR passage) may comprise a restriction, and/or the EGR pressure sensor and/or the exhaust gas pressure sensor is/are degraded. However, if the EGR pressure sensor is determined to be not degraded during method 300, then one or more the EGR pressure sensor, the EGR tube, or the EGR valve is degraded during the method 400 of FIG. 4. If the EGR pressure sensor is not determined to be degraded during the method 200 and the cooler is not requesting a cleaning, then one or more of the EGR valve and/or the EGR passage comprises a restriction. In one example, to determine if the EGR valve is restricted, the EGR valve may be oscillated between fully open and fully closed positions. If the EGR pressure sensor feedback changes in conjunction with the changing positions of the EGR valve, then it may be determined that the EGR valve is operating as desired and the EGR passage comprises a restriction.

Figure 5:
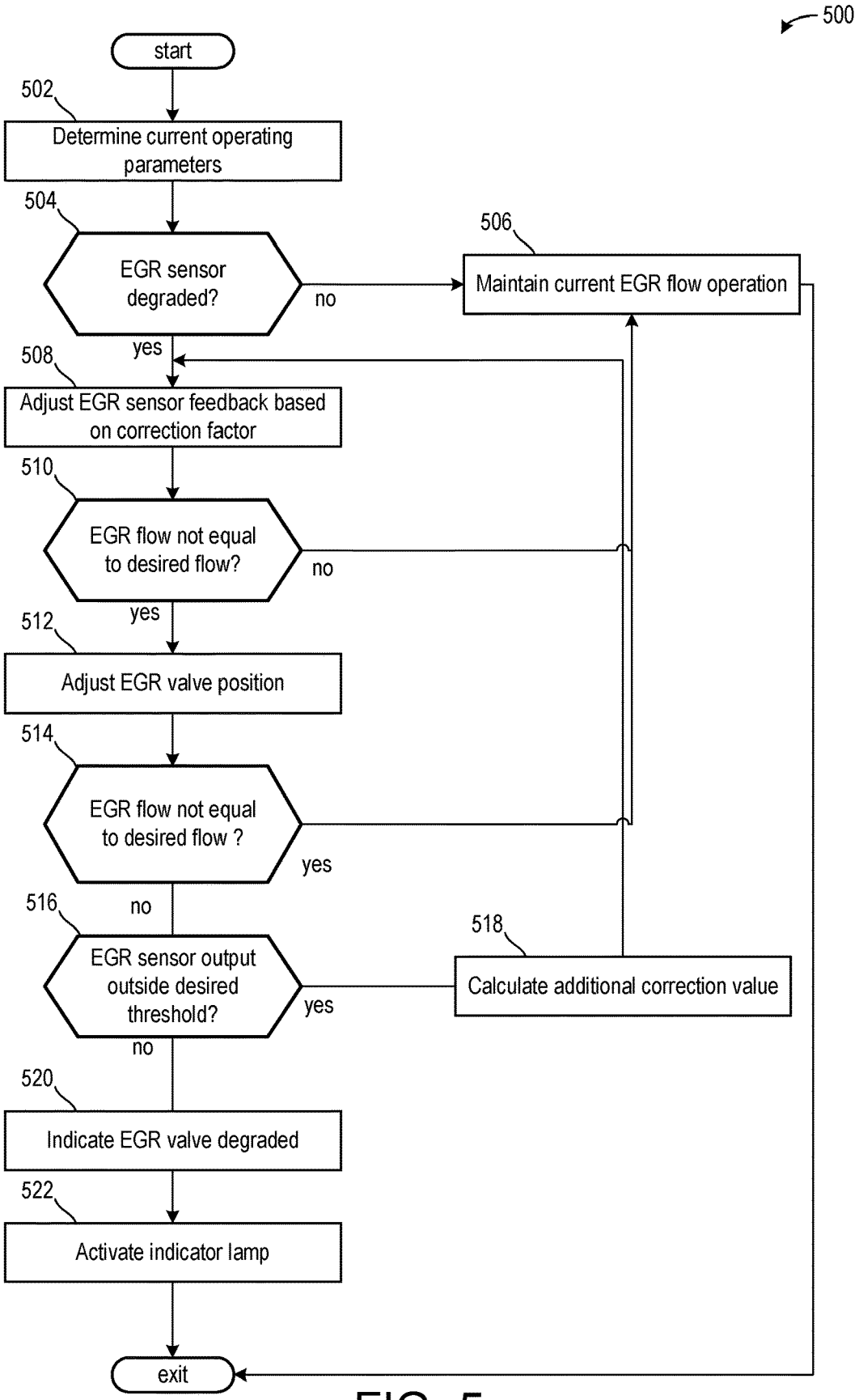
FIG. 5 illustrates a method for adjusting EGR valve operation in response to a sensor degradation and determining EGR valve degradation.

Turning now to FIG. 5, it shows a method 500 for adjusting an EGR valve operation based on an estimate of sensor degradation. The method 500 may further determine if the EGR valve is degraded following adjustments to the EGR valve positioning.

The method 500 begins at 502, which includes determining current operating parameters. Current operating parameters may include but are not limited to one or more of an intake manifold pressure, a throttle position, an engine speed, an engine temperature, an EGR request, and an air/fuel ratio.

The method 500 may proceed to 504, which includes determining if an EGR pressure sensor is degraded. As described above, for a delta pressure over the valve (DPOV) system, such as that illustrated in FIG. 1, the EGR pressure sensor is downstream of the EGR valve and an exhaust gas pressure sensor is upstream of the EGR valve. A status of the EGR pressure sensor may be determined in methods 200, 300, and 400 as described above with respect to FIGS. 2, 3, and 4, respectively.

If the EGR pressure sensor is not degraded, then the method 500 proceeds to 506, which includes maintaining current EGR flow operation. As such, an operation of the EGR valve is not adjusted in response to a determine and/or an estimated degradation of the EGR pressure sensor. If the EGR pressure sensor is degraded, then the method 500 proceeds to 508, which includes adjusting the EGR pressure sensor feedback via the correction factor.

The method 500 may proceed to 510, which includes determining if a current EGR flow is not equal to a desired EGR flow. That is to say, following applying the correction factor to an output of the EGR pressure sensor, a controller determines if the current EGR flow determination between the exhaust gas pressure sensor and the EGR pressure sensor equals a desired EGR flow.

If the EGR flow is equal to the desired EGR flow, then the method 500 proceeds to 506, which includes maintaining current EGR flow operations and does not adjust a position of the EGR valve.

If the EGR flow does not equal the desired EGR flow, then the method 500 proceeds to 512, which includes adjusting a position of the EGR valve. In one example, the EGR valve may be moved to a more open or a less open position based on a difference between the current EGR flow rate and the desired EGR flow rate. For example, if the current EGR flow rate is less than the desired EGR flow rate, then the position of the EGR valve may be adjusted to a more open position.

The method 500 proceeds to 514, which includes determining if the EGR flow is not equal to the desired flow. In one example, 514 is identical to 510 described above. If the EGR flow is equal to the desired flow, then the method 500 proceeds to 506 as described above. As such, the EGR valve is not degraded and the correction factor sufficiently adjusts feedback from the EGR pressure sensor to provide accurate monitoring of EGR flow through the EGR valve.

If the EGR flow is not equal to the desired flow, then the method 500 proceeds to 516, to determine if the EGR pressure sensor output is still outside a desired threshold. In one example, one or more of methods 200 and 400 may be executed at 516 to determine if the EGR pressure sensor is degraded for the given operating condition. If the EGR pressure sensor is still degraded, then the method 500 proceeds to 518, which includes calculating an additional correction value based on the EGR pressure sensor output at the given operating condition. The method 500 may proceed to 508.

If the EGR pressure sensor is determined not to be degraded at 516, such that its output is within the desired threshold, then the method 500 proceeds to 520, which includes indicating the EGR valve is degraded. Indicating the EGR valve is degraded may further include activating an indicator lamp at 522.

In some examples, additionally or alternatively, the controller may adjust one or more operating conditions in response to the EGR valve being degraded. In one example, the controller may cycle through a plurality of EGR valve positions to determine if all positions or only some positions of the EGR valve are degraded. Additionally or alternatively, the controller may signal an EGR valve cleaning to remove particulates and other elements accumulated thereon. In one example, the EGR valve cleaning may include increasing and exhaust temperature and exhaust backpressure such that hot exhaust gases promote a burning of the particulates accumulated onto the EGR valve. In some examples, additionally or alternatively, an engine power output may be intrusively limited by the controller (e.g., a limp mode) due to the EGR valve being degraded. As such, the engine power output may be reduced relative to a highest output. Additionally or alternatively, engine cooling may be increased during conditions where EGR is desired in response to the EGR valve being degraded.

In this way, a EGR flow characteristics may be monitored without use of a fixed orifice sensor. The exhaust gas pressure sensor and the EGR pressure sensor may be used to determine if a desired amount of EGR is flowing. The technical effect of monitoring exhaust gas pressure sensor, EGR pressure sensor, and EGR valve fidelity during various flow and no flow conditions is to enhance EGR flow characteristics. This may improve engine operation while also decreasing emissions.

An embodiment of a system, comprises a high-pressure exhaust gas recirculation (HP-EGR) system comprising a first sensor upstream of a valve and a second sensor downstream of the valve relative to a direction of exhaust gas flow, wherein the HP-EGR system is free of a fixed orifice delta pressure sensor.

A first example of the system further includes where a controller with computer-readable instructions stored on non-transitory memory thereof that when executed enable the controller to regulate HP-EGR flow based on feedback from only the first sensor and the second sensor.

A second example of the system, optionally including the first example, further includes where the instructions further enable the controller to determine a pressure ratio based on feedback from the first sensor and the second sensor in response to the valve being in an open position.

A third example of the system, optionally including one or more of the previous examples, further includes where the pressure ratio corresponds to a single position of the valve, and wherein a plurality of pressure ratios are calculated for a plurality of open positions of the valve, each pressure ratio corresponding to a single open position.

A fourth example of the system, optionally including one or more of the previous examples, further includes where the instructions further enable the controller to compare feedback from the second sensor to a manifold air pressure sensor in response to the valve being fully closed.

A fifth example of the system, optionally including one or more of the previous examples, further includes where the instructions further enable the controller to indicate a degradation of the second sensor in response to feedback from the second sensor differing from feedback from the manifold air pressure sensor by a threshold range.

A sixth example of the system, optionally including one or more of the previous examples, further includes where the instructions further enable the controller to compare an estimated HP-EGR pressure to a sensed HP-EGR pressure, wherein the estimated HP-EGR pressure is estimated via an estimated pressure drop across a cooler downstream of the second sensor, and wherein the sensed HP-EGR pressure is sensed via the second sensor.

A seventh example of the system, optionally including one or more of the previous examples, further includes where the instructions further enable the controller to indicate a degradation of the second sensor in response to the sensed HP-EGR pressure and the estimated HP-EGR pressure differing by a threshold range.

An embodiment of an engine system, comprises a high-pressure exhaust gas recirculation (HP-EGR) system comprising an EGR valve arranged between a first sensor and a second sensor in a passage, wherein the passage is fluidly coupled to an intake system comprising a manifold absolute pressure (MAP) sensor, and a controller with computer-readable instructions stored on non-transitory thereof that when executed enable the controller to compare feedback between the second sensor and the MAP sensor during conditions where the EGR valve is fully closed to determine if the second sensor is degraded, and determine if the first sensor is degraded in response to the second sensor not being degraded based on a ratio calculated via feedback from the first sensor and the second sensor.

A first example of the engine system, further includes where the first sensor is degraded if the ratio deviates from 1 by more than a desired range.

A second example of the engine system, optionally including the first example, further includes where a cooler arranged between the second sensor and the intake system.

A third example of the engine system, optionally including one or more of the previous examples, further includes where the instructions further enable the controller to estimate a pressure drop across the cooler based on one or more of a position of the EGR valve, an EGR flow rate, and wherein the pressure drop is compared to a difference between the second sensor and the MAP sensor.

A fourth example of the engine system, optionally including one or more of the previous examples, further includes where the second sensor is degraded in response to the difference deviating from the pressure drop by more than a first desired range and the compared feedback between the second sensor and the MAP sensor being different by more than a second desired range.

A fifth example of the engine system, optionally including one or more of the previous examples, further includes where the cooler requests a cleaning in response to the difference deviating from the pressure drop by more than a first desired range and the compared feedback between the second sensor and the MAP sensor being different by less than a second desired range.

A sixth example of the engine system, optionally including one or more of the previous examples, further includes where the first sensor is an exhaust gas pressure sensor upstream of the EGR valve and the second sensor is an EGR pressure sensor downstream of the valve, and wherein the HP-EGR system is free of a fixed orifice delta pressure sensor.

An embodiment of a method for a high-pressure exhaust gas recirculation system free of a fixed orifice delta pressure sensor, the method comprises comparing feedback from a first sensor to a second sensor during conditions where a position of an exhaust gas recirculation valve is outside of a fully closed position and comparing feedback from the second sensor to a manifold absolute pressure (MAP) sensor during conditions where the position of the exhaust gas recirculation valve is at the fully closed position.

A first example of the method further includes calculating a ratio based on feedback from the first sensor and the second sensor, and wherein the ratio is compared to 1.

A second example of the method, optionally including the first example, further includes determining the first sensor is degraded in response to feedback from the second sensor being equal to the MAP sensor when the exhaust gas recirculation valve is at the fully closed position.

A third example of the method, optionally including one or more of the previous examples, further includes calculating an estimated pressure drop across a cooler arranged downstream of the second sensor relative to a direction of exhaust gas flow based on an exhaust gas recirculation flow rate and the position of the exhaust gas recirculation valve, wherein the estimated pressure drop is compared to a measured pressure drop, wherein the measured pressure drop is based on a difference between the second sensor and the MAP sensor when the exhaust gas recirculation valve is outside of the fully closed position.

A fourth example of the method, optionally including one or more of the previous examples, further includes determining a matter load of the cooler being greater than a threshold load in response to the second sensor determined to not be degraded during exhaust gas recirculation valve closed conditions and the measured pressure drop differing from the estimated pressure drop during exhaust gas recirculation valve open conditions.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, 1-4, 1-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system, comprising:

a high-pressure exhaust gas recirculation (HP-EGR) system comprising a first sensor upstream of a valve and a second sensor downstream of the valve relative to a direction of exhaust gas flow, wherein the HP-EGR system is free of a fixed orifice delta pressure sensor, and further comprising a controller with computer-readable instructions stored on non-transitory memory thereof that when executed enable determination whether one or more of the sensors is degraded, wherein the instructions further enable the controller to regulate HP-EGR flow based on feedback from only the first sensor and the second sensor, and wherein the instructions further enable the controller to compare feedback from the second sensor to a manifold air pressure sensor in response to the valve being fully closed.

2. The system of claim 1, wherein the instructions further enable the controller to determine a pressure ratio based on feedback from the first sensor and the second sensor in response to the valve being in an open position.

3. The system of claim 2, wherein the pressure ratio corresponds to a single position of the valve, and wherein a plurality of pressure ratios are calculated for a plurality of open positions of the valve, each pressure ratio corresponding to a single open position.

4. The system of claim 1, wherein the instructions further enable the controller to indicate a degradation of the second sensor in response to feedback from the second sensor differing from feedback from the manifold air pressure sensor by a threshold range.

5. The system of claim 1, wherein the instructions further enable the controller to compare an estimated HP-EGR pressure to a sensed HP-EGR pressure, wherein the estimated HP-EGR pressure is estimated via an estimated pressure drop across a cooler downstream of the second sensor, and wherein the sensed HP-EGR pressure is sensed via the second sensor.

6. The system of claim 5, wherein the instructions further enable the controller to indicate a degradation of the second sensor in response to the sensed HP-EGR pressure and the estimated HP-EGR pressure differing by a threshold range.

7. An engine system, comprising:

a high-pressure exhaust gas recirculation (HP-EGR) system comprising an EGR valve arranged between a first sensor and a second sensor in a passage, wherein the passage is fluidly coupled to an intake system comprising a manifold absolute pressure (MAP) sensor; and a controller with computer-readable instructions stored on non-transitory thereof that when executed enable the controller to:

compare feedback between the second sensor and the MAP sensor during conditions where the EGR valve is fully closed to determine if the second sensor is degraded; and determine if the first sensor is degraded in response to the second sensor not being degraded based on a ratio calculated via feedback from the first sensor and the second sensor.

8. The engine system of claim 7, wherein the first sensor is degraded if the ratio deviates from 1 by more than a desired range.

9. The engine system of claim 7, further comprising a cooler arranged between the second sensor and the intake system.

10. The engine system of claim 9, wherein the instructions further enable the controller to estimate a pressure drop across the cooler based on one or more of a position of the EGR valve, an EGR flow rate, and wherein the pressure drop is compared to a difference between the second sensor and the MAP sensor.

11. The engine system of claim 10, wherein the second sensor is degraded in response to the difference deviating from the pressure drop by more than a first desired range and the compared feedback between the second sensor and the MAP sensor being different by more than a second desired range.

12. The engine system of claim 10, wherein the cooler requests a cleaning in response to the difference deviating from the pressure drop by more than a first desired range and the compared feedback between the second sensor and the MAP sensor being different by less than a second desired range.

13. The engine system of claim 7, wherein the first sensor is an exhaust gas pressure sensor upstream of the EGR valve and the second sensor is an EGR pressure sensor downstream of the valve, and wherein the HP-EGR system is free of a fixed orifice delta pressure sensor.

14. A method for a high-pressure exhaust gas recirculation system free of a fixed orifice delta pressure sensor, the method, comprising:

comparing, using a controller with computer-readable instructions stored on non- transitory memory thereof, feedback from a first sensor to a second sensor during conditions where a position of an exhaust gas recirculation valve is outside of a fully closed position; and comparing, using the controller with computer-readable instructions stored on non-transitory memory thereof, feedback from the second sensor to a manifold absolute pressure (MAP) sensor during conditions where the position of the exhaust gas recirculation valve is at the fully closed position.

15. The method of claim 14, further comprising calculating a ratio based on feedback from the first sensor and the second sensor, and wherein the ratio is compared to 1.

16. The method of claim 15, further comprising determining the first sensor is degraded in response to feedback from the second sensor being equal to the MAP sensor when the exhaust gas recirculation valve is at the fully closed position.

17. The method of claim 14, further comprising calculating an estimated pressure drop across a cooler arranged downstream of the second sensor relative to a direction of exhaust gas flow based on an exhaust gas recirculation flow rate and the position of the exhaust gas recirculation valve, wherein the estimated pressure drop is compared to a measured pressure drop, wherein the measured pressure drop is based on a difference between the second sensor and the MAP sensor when the exhaust gas recirculation valve is outside of the fully closed position.

18. The method of claim 17, further comprising determining a matter load of the cooler being greater than a threshold load in response to the second sensor determined to not be degraded during exhaust gas recirculation valve closed conditions and the measured pressure drop differing from the estimated pressure drop during exhaust gas recirculation valve open conditions.

* * * * *